US008722610B2

(12) United States Patent
Sehgal et al.

(10) Patent No.: US 8,722,610 B2
(45) **Date of Patent: *May 13, 2014**

(54) AUTO-EMULSIFYING CLEANING SYSTEMS AND METHODS FOR USE

(75) Inventors: Amit Sehgal, Marlton, NJ (US); Cecile Lara, Staffelfelden (FR); Ashwin Rao, Philadelphia, PA (US); Charles Aymes, Monmouth Junction, NJ (US)

(73) Assignee: Rhodia Operations, Aubervilliers (FR)

( * ) Notice: Subject to any disclaimer, the term of this patent is extended or adjusted under 35 U.S.C. 154(b) by 658 days.

This patent is subject to a terminal disclaimer.

(21) Appl. No.: 12/925,320

(22) Filed: Oct. 19, 2010

(65) Prior Publication Data

US 2011/0088728 A1 Apr. 21, 2011

Related U.S. Application Data

(60) Provisional application No. 61/279,306, filed on Oct. 19, 2009.

(51) Int. Cl.
*C11D 3/20* (2006.01)
*C11D 1/24* (2006.01)

(52) U.S. Cl.
USPC ..... 510/365; 510/477; 510/495; 510/426; 510/357; 510/356

(58) Field of Classification Search
USPC ..... 510/477, 495, 426, 365, 357, 356
See application file for complete search history.

(56) References Cited

U.S. PATENT DOCUMENTS

| | | | | |
|---|---|---|---|---|
| 4,470,928 A | | 9/1984 | Kimura et al. | 260/239.3 |
| 4,623,748 A | * | 11/1986 | Johnson | 560/204 |
| 4,673,524 A | | 6/1987 | Dean | 252/118 |
| 4,934,391 A | | 6/1990 | Futch et al. | 134/40 |

(Continued)

FOREIGN PATENT DOCUMENTS

| | | | |
|---|---|---|---|
| DK | WO 01/30957 A1 | 10/2000 | C11D 7/50 |
| WO | WO 94/17145 | 4/1994 | C09D 9/04 |
| WO | WO 2005/028606 A1 | 3/2003 | C11D 17/04 |
| WO | WO 2006/055713 A1 | 5/2006 | C11D 17/00 |

OTHER PUBLICATIONS

F M Ghuiba & O M O Habib, "The Use of Egyptian Fusel Oil for the Preparation of Some Plasticizers Compatible with Polyvinyl Chloride", Indian Journal of Technology, vol. 23, Aug. 1985, pp. 309-311.

(Continued)

*Primary Examiner* — Saeed T Chaudhry

(57) ABSTRACT

An auto-emulsifying cleaning composition capable of emulsifying upon contact with water, the composition in one typical embodiment comprising, based on the total weight of the composition, (a) from about 1% to about 99% by weight a blend of dibasic esters; (b) from about 1% to about 40% by weight of a blend of surfactants consisting of an organic anion neutralized with an organic cation, where either or both of the anion and the cation have surfactant properties, and the complex of which is soluble in the dibasic ester solvent blend. The blend of surfactants is typically a cationic surfactant and an anionic surfactant, which may or may not be used in conjunction with non-ionic surfactants. The dibasic esters are be derived from a blend of adipic, glutaric, and succinic diacids, and, in one particular embodiment, the blend comprises dialkyl adipate, dialkyl methylglutarate and dialkyl ethylsuccinate, wherein the alkyl groups individually comprise a $C_1$-$C_{12}$ hydrocarbon group.

12 Claims, 3 Drawing Sheets

(56) References Cited

U.S. PATENT DOCUMENTS

| | | | | | |
|---|---|---|---|---|---|
| 5,024,780 | A | | 6/1991 | Leys | 252/162 |
| 5,084,200 | A | | 1/1992 | Dishart et al. | 252/173 |
| 5,204,010 | A | * | 4/1993 | Klewsaat | 510/527 |
| 5,252,780 | A | | 10/1993 | Ramos et al. | 174/161 R |
| 5,290,365 | A | * | 3/1994 | Whitton | 134/38 |
| 5,346,640 | A | | 9/1994 | Leys | 252/162 |
| 5,419,848 | A | | 5/1995 | Van Eenam | 252/164 |
| 5,573,710 | A | | 11/1996 | McDonnell | 510/405 |
| 5,672,579 | A | | 9/1997 | Diaz et al. | 510/405 |
| 6,165,962 | A | * | 12/2000 | Kaler et al. | 510/365 |
| 6,172,031 | B1 | | 1/2001 | Stevens | 510/417 |
| 6,284,720 | B1 | | 9/2001 | Opre | 510/170 |
| 6,306,223 | B1 | | 10/2001 | Joye | 134/28 |
| 6,355,113 | B1 | | 3/2002 | Nalewajek et al. | 134/26 |
| 6,368,358 | B1 | | 4/2002 | Glenn et al. | 8/115.6 |
| 6,706,676 | B2 | | 3/2004 | Swensen | 510/174 |
| 7,199,092 | B2 | | 4/2007 | Lu et al. | 510/238 |
| 1,271,140 | A1 | | 9/2007 | Durrant | 510/276 |
| 7,309,684 | B2 | | 12/2007 | Filippini et al. | 510/201 |
| 2003/0216268 | A1 | | 11/2003 | Swensen | 510/174 |
| 2004/0000329 | A1 | | 1/2004 | Albu et al. | 134/38 |
| 2004/0200007 | A1 | | 10/2004 | Heim | 8/148 |
| 2006/0135683 | A1 | | 6/2006 | Adam et al. | 524/556 |
| 2006/0258555 | A1 | | 11/2006 | Filippini et al. | 510/417 |
| 2007/0043152 | A1 | | 2/2007 | Bernard et al. | 524/366 |
| 2007/0093404 | A1 | | 4/2007 | Gross et al. | 510/407 |

OTHER PUBLICATIONS

Solo Pak Pty Ltd, "Earth Renewable Heavy Duty Degreaser", Material Safety Data Sheet, pp. 1-6, Sep. 25, 2008.

* cited by examiner

AUTO-EMULSIFYING CLEANING SYSTEMS AND METHODS FOR USE

CROSS REFERENCE TO RELATED APPLICATIONS

This application claims the benefit of U.S. Provisional Application Ser. No. 61/279,306, filed Oct. 19, 2009, herein incorporated by reference.

FIELD OF THE INVENTION

The present invention relates to self-emulsifying or auto-emulsifying systems and in particular environmentally friendly cleaning compositions containing dibasic ester solvents capable of auto-emulsifying upon contact with water, which greatly aids in the removal of cleaning composition residues upon contact with rinse water.

BACKGROUND OF THE INVENTION

Many consumers in the cleaning industry are demanding more environmentally-friendly cleaning products. However, current non-environmentally-friendly cleaning products incorporate aromatic-based solvents such as toluene, xylene, etc., or are glycol ether-based solvents or chlorinated solvents. The use of these and related solvents is also not desirable because of their harmful health and safety profile and potential pollution and environmental problems associated with the disposal of such solvents.

This has therefore necessitated the use of environmentally friendly solvents in cleaning applications. However, many environmentally friendly solvents face many drawbacks. For example, the low volatility associated with some of these solvents brings with it a unique set of challenges pertaining to the removal of the solvent after cleaning. Typically, after a cleaning operation, the excess solvent is removed by evaporation or by rinsing in water. The high boiling point of a low VOC solvent often makes the first process unviable, as evaporation is extremely slow. The latter process is likewise unviable as the efficiency of removal is dictated by the solubility of the solvent in water, which is limited. When the cleaning solvent has limited solubility in water, its removal from the cleaned surface requires the use of a large quantity of water and the solvent can often leave behind an undesirable oily residue.

Thus, what is desired is for a novel cleaning composition that can remove stains such as paint and ink from a substrate and then can be easily rinsed with water without leaving any residue on the surface of the substrate.

SUMMARY OF THE INVENTION

The invention addresses the problem of the difficulty in emulsifying dibasic esters (or other environmentally friendly solvents) in water, which impacts the removal of such solvents during cleaning applications. Dibasic esters, and in particular, the dibasic ester blend incorporated into the present invention, have emerged as a promising environment friendly alternative to many commonly used organic solvents in a range of cleaning applications. The environment friendly attributes of these solvents include properties such as biodegradability, low odor and low VOC. However, such environmentally attributes also pose challenges pertaining to the removal of the solvent after cleaning. The present invention addresses the problem of easily removing a partially water soluble solvent through use of a surfactant blend that spontaneously emulsifies the solvent in water. In one aspect, the surfactant blend consists of an organic anion neutralized with an organic cation, where either or both the anion and the cation have surfactant properties, and the complex of which is soluble in the dibasic ester solvent blend. This surfactant complex may or may not be used in conjunction with non-ionic surfactants.

The present invention results in a cleaning composition (comprising a solvent/surfactant blend) that will spontaneously emulsify or auto-emulsify in the presence of water. Such emulsification may occur when a surface coated with the blend is rinsed with water for cleaning purposes or during the process of mixing the blend in water to prepare a formulation. The formulations described herein will result in a reduction in the quantity of water required to rinse the solvent from a surface, which can me measured through reflectivity measurements. Another consequence of this invention is that it reduces the amount of mechanical energy required to emulsify the solvent in water thereby leading to a simpler and more energy efficient manufacturing process that can be adapted by end users of this solvent.

The present invention, in one embodiment, comprises a blend of surfactants that include anionic as well as cationic surfactants that are soluble in the dibasic ester. When the blend is contacted with water, it is possible to obtain a stable three phase system comprising of a solvent rich phase, a water rich phase and a micro emulsion phase. In one embodiment, the anionic surfactants may be linear or branched surfactants having phosphate or sulfates as the anionic group. In one embodiment, the cationic surfactants can be linear or branched molecules that have an amine as the cationic group. The surfactants used for auto-emulsification are soluble in both the organic as well as aqueous phases. Self-emulsifying or auto-emulsifying systems are generally characterized by qualitatively observe the spontaneous formation of a micro-emulsion phase at the interface between the oil and water, when water is added gently without bringing any mechanical energy to the system. US Publication No. 20070043152 to Jean-Marie Bernard, et al. describes the mechanism of spontaneous emulsification, the energy required to form an emulsion concerns only the energy required to redistribute the material to be emulsified in the mixture: thus, there is no need for external energy, essentially stirring energy, to create the emulsion. In other words, the energy required for stirring that ensures macroscopically uniform distribution of the discontinuous phase is more than sufficient (for example manual stirring).

Depending on the anionic-cationic surfactant couple concerned, the total surfactant concentration in the diester phase varies in one embodiment from about 1 to 75% in weight by weight of the composition, in another embodiment from about 5 to 45% in weight, and in yet another embodiment from about 1 to 30% in weight.

The present invention will become apparent from the following detailed description and examples, which in one aspect is a composition characterized by being spontaneously emulsifiable, self-emulsifiable and/or auto-emulsifiable (hereinafter all also referred to as "auto-emulsifying" or "auto-emulsification"), based on the total weight of the composition, (a) from about 1% to about 60% by weight a blend of dibasic esters; (b) from about 1% to about 75% by weight two or more surfactants, typically selected from any combination of a nonionic, cationic, anionic, zwitterionic or amphoteric surfactant, more typically selected from a cationic surfactant and an anionic surfactant; and (c) optionally, water and/or an additive.

In one aspect, described herein are cleaning compositions comprising, based on the total weight of the composition, (a) a blend of dibasic esters comprising (i) a dialkyl methylglutarate and (ii) at least one of a dialkyl adipate or a dialkyl ethylsuccinate; and (b) from about 1% to about 75% by weight a surfactant blend of at least two surfactants, whereby the cleaning composition is capable of auto-emulsifying upon contact with water.

In one embodiment, the blend of dibasic esters has a general formula:

(I)

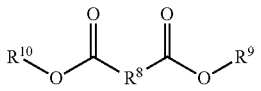

wherein $R^9$ and $R^{10}$ independently comprise a hydrocarbon chain containing about 1 to about 10 carbon atoms, and wherein $R^8$ is a mixture of at least two of —$CH_2$—$CH_2$—$CH_2$—$CH_2$—, —$CH(CH_3)$—$CH_2$—$CH_2$—, and —$CH(C_2H_5)$—$CH_2$—.

In another embodiment, the blend of dibasic esters comprises:

(i) about 7-14%, by weight of the blend, a dibasic ester of formula:

(I)

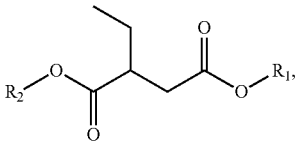

(ii) about 80-94%, by weight of the blend, a dibasic ester of formula (II)

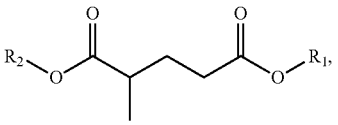

and (iii) about 0.5-5%, by weight of the blend, a dibasic ester of formula (III)

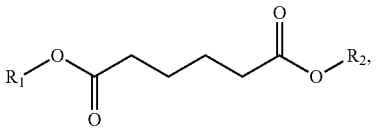

wherein $R_1$ and $R_2$ individually comprise a $C_1$-$C_{10}$ hydrocarbon group.

In another aspect, the present invention is a method for cleaning a surface comprising the steps of: a) contacting the cleaning composition of the present invention to a substrate that desired to be cleaned and b) rinsing the cleaning composition with water, whereby the cleaning composition auto-emulsifies upon contact with the water.

In one embodiment, the blend of dibasic esters is derived from one or more by-products in the production of polyamide.

In one embodiment, the surfactant blend comprises at least two surfactants from the group of a non-ionic surfactant, an anionic surfactant, a cationic surfactant and any combination thereof. The two or more surfactants can comprise at least one cationic surfactant and at least one anionic surfactant. The cationic surfactant or neutral surfactant can be from the group of cationic ethoxylated fatty amines, alkyl dimethylamines, alkyl amidopropylamines, cycloalkyl amine, alkyl imidazoline derivatives, quaternised amine ethoxylates, quaternary ammonium compounds and any combination thereof. The anionic surfactant can be selected from the group consisting of alkylbenzene sulfonates, alpha olefin sulfonates, paraffin sulfonates, alkyl ester sulfonates, alkyl ether phosphates, alkyl sulfates, polyoxyethylene alkyl ether phosphate, alkyl ether sulphates, alkyl alkoxy sulfates, alkyl sulfonates, alkyl alkoxy carboxylates, alkyl alkoxylated sulfates, monoalkyl phosphates, dialkyl phosphates, alkyl naphthalene sulphonates, alkyl phosphates, alkyl benzene sulphonic acids, alkyl benzene sulphonic acid salts, alkyl phenol ether phosphates, alkyl phenol ether sulphates, alpha olefin sulphonates, sarcosinates, sulfosuccinates, isethionates, taurates, and any combination thereof.

In one embodiment, the anionic surfactant is selected from the group consisting of an alkylbenzene sulfonate, alkyl ether phosphates, polyoxyethylene alkyl ether phosphate, and any combination thereof.

In another embodiment, the surfactant blend is selected from the group consisting of a polyoxyethylene tridecyl ether phosphate, alkylbenzene sulfonate, an ethoxylated fatty amine, cycloalkylamine, isopropylamine and any combination thereof.

In yet another embodiment, the surfactant blend comprises a polyoxyethylene tridecyl ether phosphate and a cationic ethoxylated fatty amine. In a further embodiment, the surfactant blend comprises a polyoxyethylene tridecyl ether phosphate and a cyclohexyl amine. In another embodiment, the surfactant blend comprises a polyoxyethylene dodecylbenzene sulfonate and an isopropylamine.

In yet another aspect, described are methods for cleaning a substrate surface comprising the steps of: a) contacting a cleaning composition to a surface that is desired to be cleaned (the composition comprising, based on the total weight of the composition: (i) from about 1% to about 99% by weight a blend of dibasic esters comprising (A) a dialkyl methylglutarate and (B) at least one of a dialkyl adipate or a dialkyl ethylsuccinate; (ii) from about 1% to about 75% by weight a surfactant blend); and b) rinsing the composition from the surface with water, whereby the composition is capable of auto-emulsifying into the water upon contact.

In one embodiment, the surfactant blend comprises at least two surfactants selected from the group consisting of cationic ethoxylated fatty amines, alkyl dimethylamines, alkyl amidopropylamines, cycloalkyl amine, alkyl imidazoline derivatives, quaternised amine ethoxylates, quaternary ammonium compounds, alkylbenzene sulfonates, alpha olefin sulfonates, paraffin sulfonates, alkyl ester sulfonates, alkyl ether phosphates, alkyl sulfates, polyoxyethylene alkyl ether phosphate, alkyl ether sulphates, alkyl alkoxy sulfates, alkyl sulfonates, alkyl alkoxy carboxylates, alkyl alkoxylated sulfates, monoalkyl phosphates, dialkyl phosphates, alkyl naphthalene sulphonates, alkyl phosphates, alkyl benzene sulphonic acids, alkyl benzene sulphonic acid salts, alkyl phenol ether phosphates, alkyl phenol ether sulphates, alpha olefin sulphonates, sarcosinates, sulfosuccinates, isethionates, taurates, and any combination thereof.

In another embodiment, surfactant blend comprises a polyoxyethylene tridecyl ether phosphate and a cationic ethoxylated fatty amine. In another embodiment, the surfactant blend comprises a polyoxyethylene tridecyl ether phosphate and a cyclohexyl amine. In a further embodiment, the surfactant blend comprises a polyoxyethylene dodecylbenzene sulfonate and an isopropylamine.

DETAILED DESCRIPTION

Figure 1:
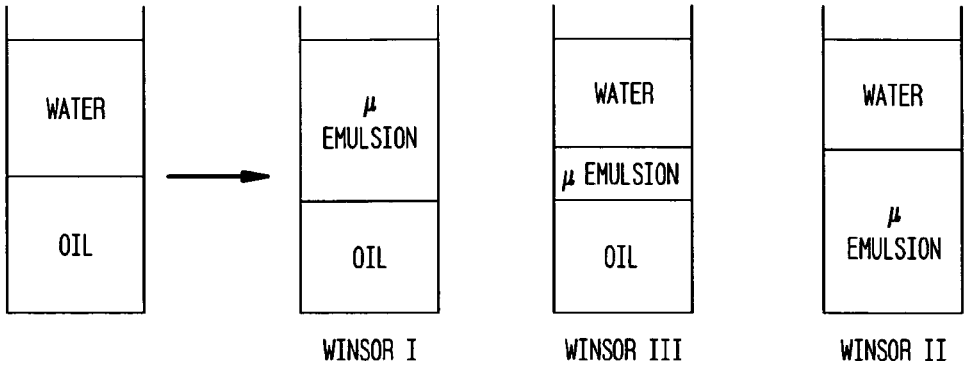
FIG. 1 is an illustration of the three types of phases in a Winsor phase diagram.

As used herein, the term "alkyl" means a saturated straight chain, branched chain, or cyclic hydrocarbon radical, including but not limited to, methyl, ethyl, n-propyl, iso-propyl, n-butyl, sec-butyl, t-butyl, pentyl, n-hexyl, and cyclohexyl.

As used herein, the terminology "($C_r$-$C_s$)" in reference to an organic group, wherein r and s are each integers, indicates that the group may contain from r carbon atoms to s carbon atoms per group.

In one typical embodiment, the composition of the present invention are formulations developed using a non-toxic, non-flammable and biodegradable dibasic ester solvent as described herein (e.g., Rhodiasolv Iris, manufactured by Rhodia Inc.), a cationic surfactant—ethoxylated fatty amine (e.g., Rhodameen T15, manufactured by Rhodia Inc.) and an anionic surfactant—a polyoxyethylene tridecyl ether phosphate (e.g., Rhodafac family, manufactured by Rhodia Inc.). The composition of the present invention has environmentally friendly characteristics such as being non toxic, biodegradable, low VOC and non-flammable. It is understood, however, that the cationic and anionic surfactants are not merely limited to the above embodiments. Cationic surfactants that can be used in the present invention may be any suitable cationic surfactant having an amine functional group. Anionic surfactants that can be used in the present invention may be any suitable anionic surfactant having a phosphate, phosphonate, sulfate, sulfonate and/or sulfosuccinate functional group.

Generally, auto-emulsifying systems are characterized by:

They solubilize large quantities of oil and connate water.

In the presence of excess quantities of oil and water, a third surfactant rich middle phase is formed.

The interfacial tensions between the excess phases and the surfactant rich phase are low ($10^{-3}$ mN/m).

The conditions for low tensions occur when, at certain surfactant concentrations and combinations, the system divides into three distinct fluid phases, the middle phase containing most of the surfactant. Criteria permitting the screening of micro-emulsion systems can be thus chosen as follows:

The measurement of interfacial tensions, typically, optimal formulation for oil recovery closely corresponds to that for which the interfacial tensions between the excess oil and water phases and the surfactant rich phase in the middle are equal.

The determination of the point in the 3-phases region for which the volume of oil solubilized into the middle phase equals the volume of brine (same solubilization parameters). The system with the largest solubilization parameter is the more efficient in recovering oil. Increased solubilization parameter indeed results in decreased interfacial tension.

The quantification of the optimal salinity of the water phase as a midpoint of the salinity range for which the system exhibits three phases.

The same conditions which promote middle phase micro-emulsion formation yield the minimum interfacial tension between the oil and micro-emulsion and aqueous and micro-emulsion phase as well as gives the greatest solubilization of oil and electrolyte for a given amount of surfactant.

The observation of the micro-emulsion formation appears to be a reference state for the comparison of surfactants. The three phase region: micro-emulsion formation at the interface Winsor called the systems with the thermodynamically stable middle phase micro-emulsion in equilibrium with both excess oil an water phases, Type III. There are indeed three types of "Winsor" phase diagrams:

type I corresponding to a 2-phase region where the surfactant is dissolved mainly in the water phase, type II corresponding to a 2-phase region where the surfactant is dissolved mainly in the oil phase and type III corresponding to a 3-phase region where the surfactant forms a phase of its own between the water phase and oil phase.

It is possible to induce a I→III→II transition (or the reverse) by changing any one of a number of system variables like temperature, salinity of the brine phase, concentration of the co-surfactant, etc.

FIG. 1 illustrates the three types of phases described by Winsor. Referring to FIG. 1, the dibasic ester solvents (e.g., IRIS) described herein is denser than water.

The formation of microemulsions requires that the surfactant films which separate oil and water microdomains be rather flexible, and that the hydrophilic and lipophilic properties of the surfactant be roughly balanced. Very near this balance, the micro-emulsion becomes continuous in both phases and coexists with both excess water and oil. However, within conditions satisfying these overall constraints, the microstructure is quite sensitive to changes in the relative strength of hydrophilic and lipophilic interactions.

The composition comprises a blend of dibasic esters. In one embodiment, the blend comprises adducts of alcohol and linear diacids, the adducts having the formula $R_1$—OOC-A-COO—$R_2$ wherein $R_1$ and/or $R_2$ comprise, individually, a $C_1$-$C_{12}$ alkyl, more typically a $C_1$-$C_8$ alkyl, and A comprises a mixture of —$(CH_2)_4$—, —$(CH_2)_3$, and —$(CH_2)_2$—. In another embodiment, $R_1$ and/or $R_2$ comprise, individually, a $C_4$-$C_{12}$ alkyl, more typically a $C_4$-$C_8$ alkyl. In one embodiment, $R_1$ and $R_2$ can individually comprise a hydrocarbon group originating from fusel oil. In one embodiment, $R_1$ and $R_2$ individually can comprise a hydrocarbon group having 1 to 8 carbon atoms. In one embodiment, $R_1$ and $R_2$ individually can comprise a hydrocarbon group having 5 to 8 carbon atoms.

In one embodiment, the blend comprises adducts of alcohol and branched or linear diacids, the adducts having the formula R1-OOC-A-COO—R2 wherein R1 and/or R2 comprise, individually, a C1-C12 alkyl, more typically a C1-C8 alkyl, and A comprises a mixture of —(CH2)4-, —CH2CH2CH(CH3)-, and —CH2CH(C2H5)-. In another embodiment, R1 and/or R2 comprise, individually, a C4-C12 alkyl, more typically a C4-C8 alkyl. It is understood that the acid portion may be derived from such dibasic acids such as adipic, succinic, glutaric, oxalic, malonic, pimelic, suberic and azelaic acids, as well as mixtures thereof.

One or more dibasic esters used in the present invention can be prepared by any appropriate process. For example, a process for preparing the adduct of adipic acid and of fusel oil is, for example, described in the document "The Use of Egyptian Fusel Oil for the Preparation of Some Plasticizers Compatible with Polyvinyl Chloride", Chuiba et al., Indian Journal of Technology, Vol. 23, August 1985, pp. 309-311.

The dibasic esters can be obtained by a process comprising an "esterification" stage by reaction of a diacid of formula HOOC-A-COOH or of a diester of formula MeOOC-A-COOMe with a branched alcohol or a mixture of alcohols. The reactions can be appropriately catalyzed. Use is preferably made of at least 2 molar equivalents of alcohols per diacid or diester. The reactions can, if appropriate, be promoted by extraction of the reaction by-products and followed by stages of filtration and/or of purification, for example by distillation.

The diacids in the form of mixtures can in particular be obtained from a mixture of dinitrile compounds in particular produced and recovered in the process for the manufacture of adiponitrile by double hydrocyanation of butadiene. This process, used on a large scale industrially to produce the greater majority of the adiponitrile consumed worldwide, is described in numerous patents and works. The reaction for the hydrocyanation of butadiene results predominantly in the formulation of linear dinitriles but also in formation of branched dinitriles, the two main ones of which are methylglutaronitrile and ethylsuccinonitrile. The branched dinitrile compounds are separated by distillation and recovered, for example, as top fraction in a distillation column, in the stages for separation and purification of the adiponitrile. The branched dinitriles can subsequently be converted to diacids or diesters (either to light diesters, for a subsequent transesterification reaction with the alcohol or the mixture of alcohols or the fusel oil, or directly to diesters in accordance with the invention).

Dibasic esters of the present invention may be derived from one or more by-products in the production of polyamide, for example, polyamide 6,6. In one embodiment, the blend comprises linear or branched, cyclic or noncyclic, $C_1$-$C_{20}$ alkyl, aryl, alkylaryl or arylalkyl esters of adipic diacids, glutaric diacids, and succinic diacids. In another embodiment, the blend comprises linear or branched, cyclic or noncyclic, $C_1$-$C_{20}$ alkyl, aryl, alkylaryl or arylalkyl esters of adipic diacids, methylglutaric diacids, and ethylsuccinic diacids Generally, polyamide is a copolymer prepared by a condensation reaction formed by reacting a diamine and a dicarboxylic acid. Specifically, polyamide 6,6 is a copolymer prepared by a condensation reaction formed by reacting a diamine, typically hexamethylenediamine, with a dicarboxylic acid, typically adipic acid.

In one embodiment, the blend of the present invention can be derived from one or more by-products in the reaction, synthesis and/or production of adipic acid utilized in the production of polyamide, the composition comprising a blend of dialkyl esters of adipic diacids, glutaric diacids, and succinic diacids (herein referred to sometimes as "AGS" or the "AGS blend").

In one embodiment, the blend of esters is derived from by-products in the reaction, synthesis and/or production of hexamethylenediamine utilized in the production of polyamide, typically polyamide 6,6. The composition comprises a blend of dialkyl esters of adipic diacids, methylglutaric diacids, and ethylsuccinic diacids (herein referred to sometimes as "MGA", "MGN", "MGN blend" or "MGA blend").

The boiling point of the dibasic ester blend of the present invention is between the range of about 120° C. to 450° C. In one embodiment, the boiling point of the blend of the present invention is in the range of about 160° C. to 400° C.; in one embodiment, the range is about 210° C. to 290° C.; in another embodiment, the range is about 210° C. to 245° C.; in another embodiment, the range is the range is about 215° C. to 225° C. In one embodiment, the boiling point range of the blend of the present invention is between about 210° C. to 390° C., more typically in the range of about 280° C. to 390° C., more typically in the range of 295° C. to 390° C. In one embodiment, boiling point of the blend of the present invention is in the range of about 215° C. to 400° C., typically in the range of about 220° C. to 350° C.

In one embodiment, the blend of dibasic esters has a boiling point range of between about 300° C. and 330° C. Typically, the diisoamyl AGS blend is associated with this boiling point range. In another embodiment, the dibasic ester blend of the present invention has a boiling point range of between about 295° C. and 310° C. Typically, the di-n-butyl AGS blend is associated with this boiling point range. Generally, a higher boiling point, typically, above 215° C., or high boiling point range corresponds to lower VOC.

In certain embodiments, the dibasic ester blend comprises:

a diester of formula I:

(I)

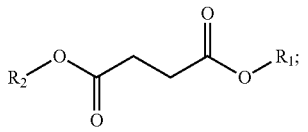

a diester of formula II:

(II)

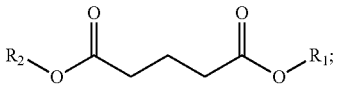

and a diester of formula III:

(III)

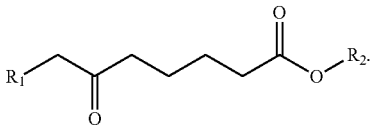

$R_1$ and/or $R_2$ can individually comprise a hydrocarbon having from about 1 to about 8 carbon atoms, typically, methyl, ethyl, propyl, isopropyl, butyl, isobutyl, n-butyl, isoamyl, hexyl, heptyl or octyl. In such embodiments, the blend typically comprises (by weight of the blend) (i) about 15% to about 35% of the diester of formula I, (ii) about 55% to about 70% of the diester of formula II, and (iii) about 7% to about 20% of the diester of formula III, and more typically, (i) about 20% to about 28% of the diester of formula I, (ii) about 59% to about 67% of the diester of formula II, and (iii) about 9% to about 17% of the diester of formula III. The blend is generally characterized by a flash point of 98° C., a vapor pressure at 20° C. of less than about 10 Pa, and a distillation temperature range of about 200-300° C. Mention may also be made of Rhodiasolv® RPDE (Rhodia Inc., Cranbury, N.J.), Rhodiasolv® DIB (Rhodia Inc., Cranbury, N.J.) and Rhodiasolv® DEE (Rhodia Inc., Cranbury, N.J.).

In certain alternative embodiments, the dibasic ester blend comprises:

a diester of the formula IV:

(IV)

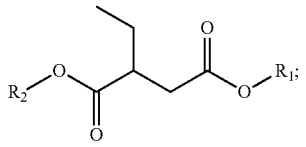

a diester of the formula V:

(V)

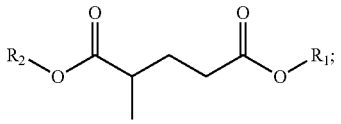

and a diester of the formula VI:

(VI)

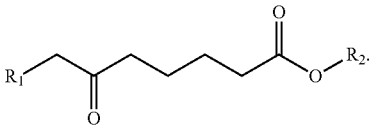

$R_1$ and/or $R_2$ can individually comprise a hydrocarbon having from about 1 to about 8 carbon atoms, typically, methyl, ethyl, propyl, isopropyl, butyl, isobutyl, n-butyl, isoamyl, hexyl, heptyl, or octyl. In such embodiments, the blend typically comprises (by weight of the blend) (i) from about 5% to about 30% of the diester of formula IV, (ii) from about 70% to about 95% of the diester of formula V, and (iii) from about 0% to about 10% of the diester of formula VI. More typically, the blend typically comprises (by weight of the blend): (i) from about 6% to about 12% of the diester of formula IV, (ii) from about 86% to about 92% of the diester of formula V, and (iii) from about 0.5% to about 4% of the diester of formula VI.

Most typically, the blend comprises (by weight of the blend): (i) about 9% of the diester of formula IV, (ii) about 89% of the diester of formula V, and (iii) about 1% of the diester of formula VI. The blend is generally characterized by a flash point of of 98° C., a vapor pressure at 20° C. of less than about 10 Pa, and a distillation temperature range of about 200-275° C. Mention may be made of Rhodiasolv® IRIS and Rhodiasolv® DEE/M, manufactured by Rhodia Inc. (manufactured by Rhodia Inc., Cranbury, N.J.).

According to one embodiment of the present invention, the blend of dibasic esters corresponds to one or more by-products of the preparation of adipic acid, which is one of the main monomers in polyamides. For example, the dialkyl esters are obtained by esterification of one by-product, which generally contains, on a weight basis, from 15 to 33% succinic acid, from 50 to 75% glutaric acid and from 5 to 30% adipic acid. As another example, the dialkyl esters are obtained by esterification of a second by-product, which generally contains, on a weight basis, from 30 to 95% methyl glutaric acid, from 5 to 20% ethyl succinic acid and from 1 to 10% adipic acid. It is understood that the acid portion may be derived from such dibasic acids such as, adipic, succinic, glutaric, oxalic, malonic, pimelic, suberic and azelaic acids, as well as mixtures thereof.

The composition of the present invention may also contain one or more surfactants or a blend of surfactants. The surfactant or blend of surfactants of the present invention can be any number of cationic, amphoteric, zwitterionic, anionic or non-ionic surfactants, derivatives thereof, as well as blends (combinations) of any such surfactants.

In one embodiment, the nonionic surfactants generally includes one or more of for example amides such as alkanolamides, ethoxylated alkanolamides, ethylene bisamides; esters such as fatty acid esters, glycerol esters, ethoxylated fatty acid esters, sorbitan esters, ethoxylated sorbitan; ethoxylates such as alkylphenol ethoxylates, alcohol ethoxylates, tristyrylphenol ethoxylates, mercaptan ethoxylates; end-capped and EO/PO block copolymers such as ethylene oxide/propylene oxide block copolymers, chlorine capped ethoxylates, tetra-functional block copolymers; amine oxides such lauramine oxide, cocamine oxide, stearamine oxide, stearamidopropylamine oxide, palmitamidopropylamine oxide, decylamine oxide; fatty alcohols such as decyl alcohol, lauryl alcohol, tridecyl alcohol, myristyl alcohol, cetyl alcohol, stearyl alcohol, oleyl alcohol, linoleyl alcohol and linolenyl alcohol; and alkoxylated alcohols such as ethoxylated lauryl alcohol, trideceth alcohols; and fatty acids such as lauric acid, oleic acid, stearic acid, myristic acid, cetearic acid, isostearic acid, linoleic acid, linolenic acid, ricinoleic acid, elaidic acid, arichidonic acid, myristoleic acid and mixtures thereof. In another embodiment, the non-ionic surfactant is a glycol such as polyethylene glycol (PEG), alkyl PEG esters, polypropylene glycol (PPG) and derivatives thereof. In one embodiment, the surfactant is an alcohol ethoxylate, an alkyl phenol ethoxylate or a terpene alkoxylate.

In another embodiment, the surfactant is a cationic surfactant. The cationic surfactant includes but is not limited to linear or branched ethoxylated fatty amines, alkyl dimethylamines, alkyl amidopropylamines, cycloalkyl amine, alkyl imidazoline derivatives, quaternised amine ethoxylates, and quaternary ammonium compounds, such as cetyl trimethyl ammonium bromide (also known as CETAB or cetrimonium bromide), cetyl trimethyl ammonium chloride (also known as cetrimonium chloride), myristyl trimethyl ammonium bromide (also known as myrtrimonium bromide or Quaternium-13), stearyl dimethyl distearyldimonium chloride, dicetyl dimonium chloride, stearyl octyldimonium methosulfate, dihydrogenated palmoylethyl hydroxyethylmonium methosulfate, isostearyl benzylimidonium chloride, cocoyl benzyl hydroxyethyl imidazolinium chloride, dicetyl dimonium chloride and distearyldimonium chloride; isostearylaminopropalkonium chloride or olealkonium chloride; behentrimonium chloride; as well as mixtures thereof. In one particular embodiment, the cationic surfactant is an ethoxylated fatty amine or a cycloalkyl amine.

In another embodiment, the surfactant is an anionic surfactant. The anionic surfactant includes but is not limited to linear and/or branched alkylbenzene sulfonates, alpha olefin sulfonates, paraffin sulfonates, alkyl ester sulfonates, alkyl ether phosphates, alkyl sulfates, alkyl ether sulphates, alkyl alkoxy sulfates, alkyl sulfonates, alkyl alkoxy carboxylates, alkyl alkoxylated sulfates, monoalkyl phosphates, polyoxyethylene alkyl ether phosphate, dialkyl phosphates, alkyl naphthalene sulphonates, alkyl phosphates, alkyl benzene sulphonic acids and salts, alkyl phenol ether phosphates, alkyl phenol ether sulphates, alpha olefin sulphonates, sarcosinates, sulfosuccinates, isethionates, and taurates, as well as mixtures thereof. Branched anionic surfactants include but are not limited to sodium trideceth sulfate, sodium tridecyl sulfate, ammonium trideceth sulfate, ammonium tridecyl sulfate, and sodium trideceth carboxylate. In one embodiment, the anionic surfactant is an ether phosphate. In one embodiment, the anionic surfactant is a polyoxyethylene tridecyl ether phosphate.

Any amphoteric surfactant that is acceptable for use includes but is not limited to derivatives of aliphatic secondary and tertiary amines in which the aliphatic radical can be straight chain or branched and wherein one of the aliphatic substituents contains from about 8 to about 18 carbon atoms and one contains an anionic water solubilizing group. Specific examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates, and alkyl amphopropionates, as well as alkyl iminopropionates, alkyl iminodipropionates, and alkyl amphopropylsulfonates, such as for example, cocoamphoacetate cocoamphopropionate, cocoamphodiacetate, lauroamphoacetate, lauroamphodiacetate, lauroamphodipropionate, lauroamphodiacetate, cocoamphopropyl sulfonate caproamphodiacetate, caproamphoacetate, caproamphodipropionate, and stearoamphoacetate.

Suitable zwitterionic surfactants include alkyl betaines, such as cocodimethyl carboxymethyl betaine, lauryl dimethyl carboxymethyl betaine, lauryl dimethyl alpha-carboxyethyl betaine, cetyl dimethyl carboxymethyl betaine, lauryl bis-(2-hydroxy-ethyl)carboxy methyl betaine, stearyl bis-(2-hydroxy-propyl)carboxymethyl betaine, oleyl dimethyl gamma-carboxypropyl betaine, and lauryl bis-(2-hydroxypropyl)alpha-carboxyethyl betaine, amidopropyl betaines, and alkyl sultaines, such as cocodimethyl sulfopropyl betaine, stearyldimethyl sulfopropyl betaine, lauryl dimethyl sulfoethyl betaine, lauryl bis-(2-hydroxy-ethyl)sulfopropyl betaine, and alkylamidopropylhydroxy sultaines.

In one embodiment, the surfactant blend is a combination of

The composition of the present invention can optionally include additional components or additives such as wetting agents, solvents, defoamers, leveling agents, pigment paste, dyes etc. Other additional components include, but are not limited to, delaminates, buffering and/or pH control agents, fragrances, perfumes, dyes, whiteners, brighteners, solubilizing materials, stabilizers, corrosion inhibitors, lotions and/or mineral oils, enzymes, cloud point modifiers, preservatives, ion exchangers, chelating agents, sudsing control agents, soil removal agents, softening agents, opacifiers, inert diluents, graying inhibitors, stabilizers, polymers and the like.

EXPERIMENTS

Example 1

Cationic RhodameenT15 with the Three Phosphates (Rhodafac RS410-RS 610-RS710) as Anionic Surfactants These phosphates belong to the polyoxyethylene tridecyl ether phosphate family with an ethylene oxide number varying from 3 to 10. A cationic ethoxylated fatty amine (Rhodameen T15) was blended with three different anionic phosphate surfactants in Rhodiasolv IRIS at the following concentrations

| N° vial | Total Surfactant concentration (Weight %) | Phosphate/ amine Ratios |
|---|---|---|
| 1-RS410 | 29 | 0.4 |
| 2-RS610 | 25 | 0.5 |
| 3-RS710 | 22 | 0.6 |

The resultant IRIS surfactant blend was brought in contact with equal volume of water in the absence of any mechanical agitation. Auto-emulsification phenomenon was observed in the 1-RS410 sample, the 2-RS610 sample and the 3-RS710 sample 18 hours after contact with water. To provide a contrast between the aqueous and organic phases red nile dye was added in the organic phase, which is denser than water. Auto-emulsification of the 1-RS410, 2-RS610 and 3-RS710 samples results in the formation of a translucent interfacial region that has a light pink color. The reference solution (that did not contain any surfactant) did not auto emulsify.

Example 2

Cationic Rhodameen PN 430 with the Three Phosphates

A cationic ethoxylated fatty amine (Rhodameen PN430) was blended with three different anionic phosphate surfactants in Rhodiasolv IRIS at the following concentrations

| N° vial | Total Surfactant concentration (Weight %) | Phosphate/ amine ratios |
|---|---|---|
| 4-RS410 | 21 | 0.7 |
| 5-RS610 | 19 | 1.0 |
| 6-RS710 | 17 | 1.2 |

The resultant IRIS surfactant blend was brought in contact with equal volume of water in the absence of any mechanical agitation Auto-emulsification phenomenon was observed in the 4-RS410 sample, the 5-RS610 sample and the 6-RS710 sample 18 hours after contact with water. To provide a contrast between the aqueous and organic phases red nile dye was added in the organic phase, which is denser than water. Auto-emulsification of the 4-RS410, 5-RS610 and 6-RS710 samples results in the formation of a translucent interfacial region that has a light pink color. The reference solution (that did not contain any surfactant) did not auto emulsify.

Example 3

Auto Emulsification in a Cyclohexylamine—Phosphate Blend

Blends of anionic phosphates and cyclohexylamine dissolved in IRIS were prepared at the concentrations listed below. These blends were then brought in contact with equal volumes of water. Auto-emulsification phenomenon was observed in the 7-RS410 sample, the 8-RS610 sample and the 9-RS710 sample 18 hours after contact with water. For improved contrast, the IRIS phase was stained with hydrophobic nile red dye while the aqueous phase was stained with hydrophilic fluorescein dye. The reference solution, which contains only dibasic ester, did not auto-emulsify.

| N° vial | Weight % surfactant in the IRIS phase | Phosphate/amine Weight ratios |
|---|---|---|
| 7-RS410 | 13 | 3.5 |
| 8-RS610 | 12 | 4.7 |
| 9-RS710 | 12 | 5.8 |

Example 4

Auto Emulsification in a Isopropylamine—Sulfonate Blend

Another surfactant blend used in one embodiment of the present invention is a blend of dodecylbenzene sulfonate and isopropylamine that is commercially available as Rhodocal 330. Auto-emulsification phenomenon was observed 48 hours after intial contact of the IRIS/surfactant blend with water. To provide a contrast between the aqueous and organic phases red nile dye was added in the organic phase, which is denser than water. The concentration of the surfactant in the organic phase was varied at 5%, 10%, 15%, 20%, 25%, 30%, 35% and 40%. It was observed that increasing the surfactant concentration increases the efficiency of the emulsification process. Auto-emulsification of the 10%, 15%, 20%, 25%, 30%, 35% and 40%. samples resulted in the formation of a translucent interfacial region that has a light pink color. The reference solutions did not auto-emulsify.

Example 5

Observation of Auto Emulsification of a Solvent Droplet

Figure 2:
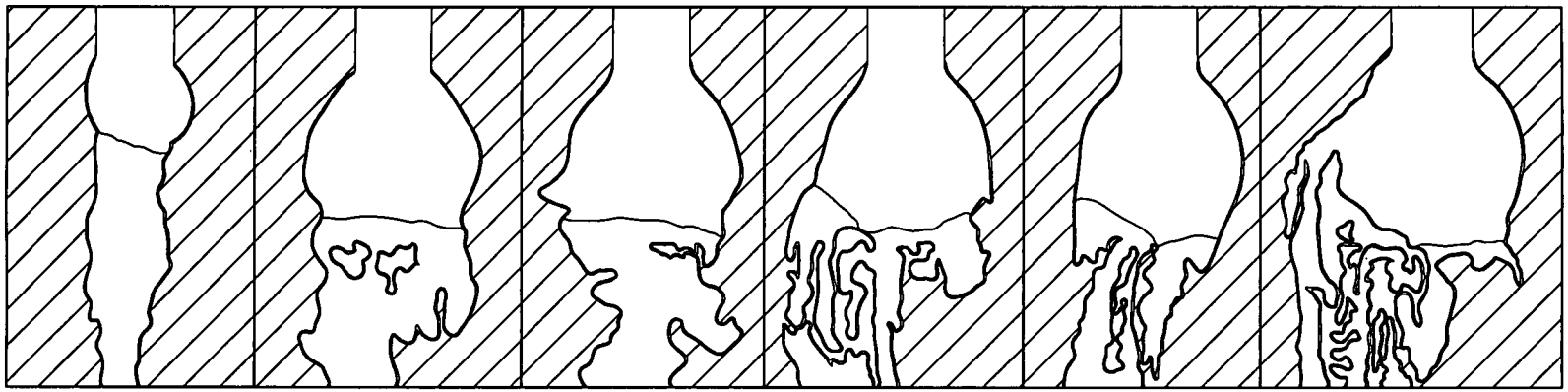
FIG. 2 shows a spontaneous break up of a drop of Rhodiasolv IRIS containing Rhodameen T15 Rhodafac 410.
Figure 3:
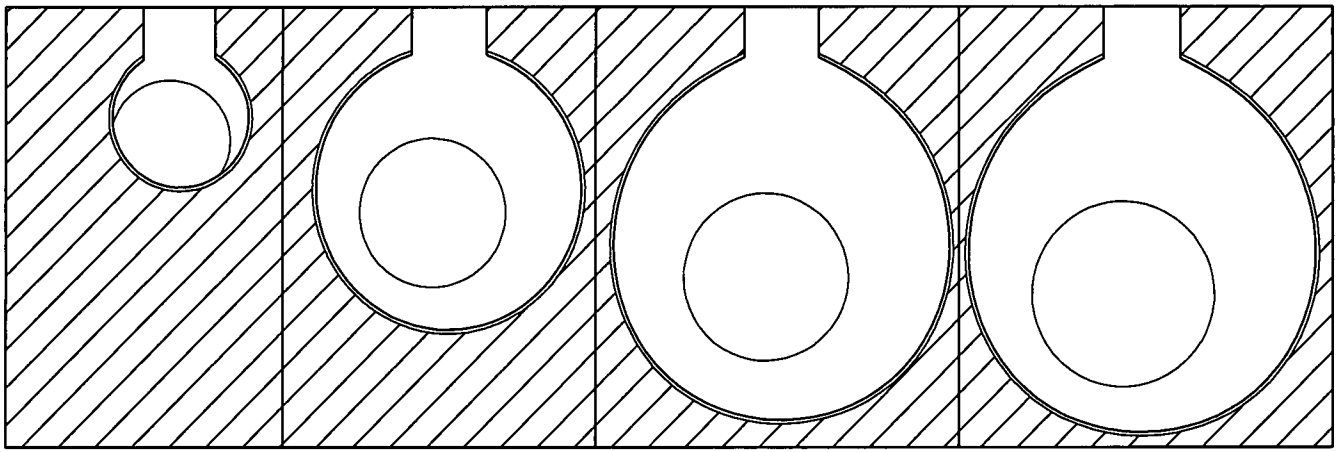
FIG. 3 shows the absence of droplet disintegration when a drop of Rhodiasolv IRIS (without the addition of surfactant) is brought in contact with water.

To demonstrate the usefulness of auto emulsification, a drop of the solvent was brought in contact with water and the subsequent dissolution of the drop was observed using a camera. As shown in FIG. 2, when the solvent contained a blend of Rhodafac 410 and Rhodamen T15, the droplet was observed to disintegrate spontaneously into many individual smaller drops. However, as shown in FIG. 3, in the absence of a surfactant blend, no such breakup was observed.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The depicted and described preferred embodiments of the invention are exemplary only and are not exhaustive of the scope of the invention. Consequently, the invention is intended to be limited only by the spirit and scope of the appended claims, giving full cognizance to equivalents in all respects.

What is claimed is:

1. A cleaning composition, the composition comprising, based on the total weight of the composition:

(a) a blend of dibasic esters comprising 1% to 99% by weight of a blend of (i) a dialkyl methylglutarate and (ii) at least one of a dialkyl adipate or a dialkyl ethylsuccinate; and (b) 1% to 75% by weight a surfactant blend of at least two surfactants comprising (i) at least one cationic surfactant selected from the group consisting of cationic ethoxylated fatty amines, alkyl dimethylamines, alkyl amidopropylamines, cycloalkyl amine, alkyl imidazoline derivatives, quaternised amine ethoxylates, quaternary ammonium compounds and (ii) at least one anionic surfactant selected from the group consisting of alkylbenzene sulfonates, alpha olefin sulfonates, paraffin sulfonates, alkyl ester sulfonates, alkyl ether phosphates, alkyl sulfates, polyoxyethylene alkyl ether phosphate, alkyl ether sulphates, alkyl alkoxy sulfates, alkyl sulfonates, alkyl alkoxy carboxylates, alkyl alkoxylated sulfates, monoalkyl phosphates, dialkyl phosphates, alkyl naphthalene sulphonates, alkyl phosphates, alkyl benzene sulphonic acids, alkyl benzene sulphonic acid salts, alkyl phenol ether phosphates, alkyl phenol ether sulphates, alpha olefin sulphonates, sarcosinates, sulfosuccinates, isethionates, polyoxyethylene tridecyl ether phosphates, polyoxyethylene dodecylbenzene sulfonates, and taurates;

whereby the cleaning composition is capable of auto-emulsifying upon contact with water.

2. The cleaning composition of claim 1 wherein the blend of dibasic esters comprises dialkyl adipate, dialkyl methylglutarate and dialkyl ethylsuccinate.

3. The cleaning composition of claim 1 wherein the blend of dibasic esters is derived from one or more by-products in the production of polyamide.

4. The cleaning composition of claim 1 wherein the blend of dibasic esters is derived from the process to produce adiponitrile.

5. The composition of claim 1 wherein the surfactant blend comprises a polyoxyethylene tridecyl ether phosphate and a cationic ethoxylated fatty amine.

6. The composition of claim 1 wherein the surfactant blend comprises a polyoxyethylene tridecyl ether phosphate and a cyclohexyl amine.

7. The composition of claim 1 wherein the surfactant blend comprises a dodecylbenzene sulfonate and an isopropylamine.

8. The composition of claim 1 wherein the blend of dibasic esters comprises:

(i) about 7-14%, by weight of the blend, a dibasic ester of formula:

(I)

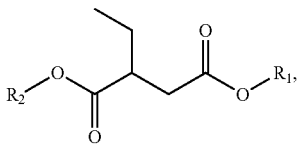

(ii) about 80-94%, by weight of the blend, a dibasic ester of formula

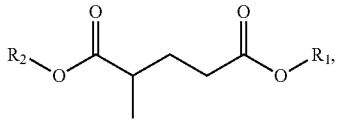

(II)

and (iii) about 0.5-5%, by weight of the blend, a dibasic ester of formula

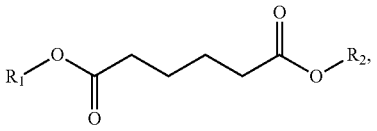

(III)

wherein $R_1$ and $R_2$ individually comprise a $C_1$-$C_{10}$ hydrocarbon group.

9. A method for cleaning a substrate surface comprising the steps of:

a) contacting auto-emulsifying a composition according to claim 1 by contacting the composition with water, b) contacting the resultant emulsion to a surface that is desired to be cleaned.

10. The method of claim 9 wherein the surfactant blend comprises a polyoxyethylene tridecyl ether phosphate and a cationic ethoxylated fatty amine.

11. The method of claim 9 wherein the surfactant blend comprises a polyoxyethylene tridecyl ether phosphate and a cyclohexyl amine.

12. The method of claim 9 wherein the surfactant blend comprises a polyoxyethylene dodecylbenzene sulfonate and an isopropylamine.

* * * * *